US007950382B2

(12) United States Patent
Maeda

(10) Patent No.: US 7,950,382 B2
(45) Date of Patent: May 31, 2011

(54) AIR GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 230 days.

(21) Appl. No.: 12/285,972

(22) Filed: Oct. 17, 2008

(65) Prior Publication Data

US 2009/0139506 A1 Jun. 4, 2009

(30) Foreign Application Priority Data

Nov. 29, 2007 (JP) ..... 2007-308569

(51) Int. Cl.
*F41B 11/00* (2006.01)

(52) U.S. Cl. ..... 124/73; 124/74; 124/76

(58) Field of Classification Search ..... 124/70–73, 124/74, 76, 75
See application file for complete search history.

(56) References Cited

U.S. PATENT DOCUMENTS 3,204,625 A * 9/1965 Shepherd ..... 124/74
4,147,152 A 4/1979 Fischer et al.
5,349,938 A * 9/1994 Farrell ..... 124/73
5,497,758 A 3/1996 Dobbins et al.
5,711,286 A * 1/1998 Petrosyan et al. ..... 124/73
7,686,004 B2 * 3/2010 Gan ..... 124/75
7,726,293 B2 * 6/2010 Wei ..... 124/74

FOREIGN PATENT DOCUMENTS

DE 20 2005 017 256 U1 1/2006
GB 2 395 543 A 5/2004

OTHER PUBLICATIONS

Extended European Search Report, App. No. 08017917.9-1260, Mar. 27, 2009 (6 pages).

* cited by examiner

*Primary Examiner* — Troy Chambers
*Assistant Examiner* — Gabriel J Klein
(74) *Attorney, Agent, or Firm* — Rader, Fishman & Grauer PLLC

(57) ABSTRACT

An air gun includes a retainer pivotably connected inside the air gun and having a bullet abutment part that pivots into and out of a bullet-receiving chamber. The retainer is resiliently biased to pivot in a forward direction so that the bullet abutment part is urged into the bullet-receiving chamber. In a trigger rest position, a hollow inner barrel prevents a bullet and the bullet abutment part from entering into the bullet-receiving chamber. Upon pulling the trigger, the inner barrel moves in a forward direction to permit the bullet and the bullet abutment part to enter the bullet-receiving chamber where the bullet abutment part contacts and retains the bullet therein. Upon pulling the trigger further, the inner barrel moves in a rearward direction to capture the bullet therein while causing the retainer to pivot in the rearward direction to thereby move the bullet abutment part out of the bullet-receiving chamber.

1 Claim, 11 Drawing Sheets

AIR GUN

BACKGROUND OF THE INVENTION

1. Field of the Invention

This invention relates to an air gun (air-powered gun). More specifically, the invention relates to an air gun with a retainer for retaining a bullet which moves from a magazine to a propulsion position of an inner barrel.

2. Description of the Related Art

An air gun in this technical field is an air gun where an inner barrel advances in the direction of a muzzle, then the inner barrel retreats to hit a valve, high pressure gas is injected from a gas chamber to the inner barrel by the movement of the valve, and a bullet is discharged.

An air gun having this mechanism is disclosed in U.S. Pat. No. 4,147,152 (related art 1). In this air gun a magazine 20 is placed above an inner barrel 72, and bullets in the magazine 20 are supplied from a loading port 294 to a retainer 160 which is situated under an inner barrel. The retainer 160 is positioned facing the lower part of the loading port 294. The retainer is an elastic body made of a rod-like member inflected. A bullet is supplied to the concave portion of the retainer 160 and retained.

In the related art 1, in order to shoot a bullet, a shooter should push a lever by hand to advance the inner barrel 72 in the direction of the muzzle, the loading port 294 is opened, a bullet in the magazine 20 drops into the inner barrel 72, is retained in the retainer 160, and the bullet is shot by pulling a trigger.

Another air gun (related art 2) with a retainer has been disclosed as shown in FIGS. 22 through 25. Also in the air gun disclosed in the related art 2, a magazine 100 is placed upper part of an inner barrel 102. A bullet W is urged in a direction of the rear side of the air gun by a magazine spring 101. Normally, it is abutted on the upper surface of a tube of the inner barrel 102 and resting. When the bullet W is shot, the inner barrel 102 moves in the direction of a muzzle. After the bullet W is shot, a next bullet drops into a chamber 103 through a magazine loading port placed on the chamber 103. The bullet W dropped in the chamber 103 is retained by a retainer 104 placed at a position opposed to the magazine loading port and biased by a magazine spring 101.

The retainer 104 disclosed in the conventional technology 2 consists of a tube whose upper part is a circular truncated cone, which is biased upward with a retainer spring 105. The upper end of the retainer 104 is formed as a circular opening. The configuration is such that the circular opening pushes upwards and retains the bullet supplied into the chamber 103. Patent document 1: Patent publication of U.S. Pat. No. 4,147, 152 (art 1)

However, the retainer disclosed in the conventional technology 1 is positioned situated under an inner barrel. The retainer (160) is positioned at the lower part of the inner barrel and an elastic body with a concave part made of a rod-like member that is inflected. Therefore, the retainer has a problem that it cannot reliably retain a bullet.

Additionally, in the air gun in the conventional technology 2 the retainer 104 is biased upwards by a retainer spring 105 so that a bullet W positioned at the circular opening is pushed upward. In other words, the bullet is pushed at right angles to the movement of the inner barrel 102. At the same time, the bullet W is pushed by the next bullet W1 from top to bottom by the biasing force of the magazine spring 101 of the magazine 100. Therefore, a biasing force stronger than that of the magazine spring 101 was required for the retainer spring 105.

Thus, the back-end of the inner barrel 102 comes into collision with the upper cone surface of the retainer 104 when the inner barrel 102 moves backwards in the gun, to move the retainer 104 downward, but the upward biasing force of the retainer spring 105 is strong and so the collision is strong, and acts as a resistance to make each member likely to be broken with prolonged use (see FIG. 23).

At the same time, the back-end of the inner barrel 102 also comes into collision with the bullet W in the chamber 103 causing resistance. If the back-end of the inner barrel 102 is deformed, it becomes difficult for the bullet W to be contained in the inner barrel 102 and the bullet cannot be shot due to bullet supply problems. (See FIG. 24).

Further, the upper surface of the cone surface of the retainer 104 always pushes the lower surface of the inner barrel 102 upward of the retainer spring 105 with the biasing force. Therefore, a friction resistance is generated between the upper surface of the cone surface of the retainer 104 and the inner barrel 102 causing members to deteriorate quickly (See FIG. 25).

When the inner barrel 102 moves backward in the gun and comes into collision with the retainer 104 and bullet W, thus reducing the recession velocity of the inner barrel 102 and reducing the force to hit the valve 107. If the force to hit the valve 107 is reduced, the amount of gas discharged from the gas chamber 106 to the inner barrel 102 is decreased or varies so that firing speed of a bullet is reduced, or the original performance of the air gun cannot be demonstrated.

As the related art 2, a bullet is supplied from the upwardly positioned magazine and retained, and so the retainer positioned below the inner barrel has a relatively large size in order to hold the strong upward biasing force, and the retainer positioned above the inner barrel is unnatural from the viewpoint of design of an air gun.

SUMMARY OF THE INVENTION

In order to solve the above-described problems, there is provided an air gun in which an inner barrel advances in the direction of a muzzle, and then retreating movement causes high-pressure gas to be injected into the inner barrel and a bullet is projected, wherein, a retainer for holding a bullet supplied from a magazine can be rotated about a retainer rotational axis from a position where a bullet is retained in the direction of the back of the gun, a part which comes in contact with a bullet abuts against a bullet to retain it, and the movement of the inner barrel toward the back of the gun causes backward rotation to release the retention of the bullet.

Additionally, an air gun mentioned in paragraph 0013 above in which a retainer can retain a bullet positioned in a chamber by substantially aligning the center of the bullet with the center of the tube of the inner barrel is proposed.

According to the present invention, the impact against the retainer by the backward movement of the inner barrel is deflected and cushioned by the rotation of the retainer. Therefore, the retainer functions less as a resistance, there is less damage to the retainer and inner barrel, the endurance of the air gun is improved, and the performance of the air gun as a gun is improved.

The retainer rotates backward, then moves to the upper part of the inner barrel and slides on the upper surface of the inner barrel. However, the friction resistance is small so the performance of the air gun as a gun is improved.

In the invention according to claim 1, the retainer holds a bullet with the center of the bullet substantially aligned with the center of the tube of the inner barrel during the period from advancement and backward movement so that the inner barrel does not come into collision with a bullet when the inner barrel moves backward and the bullet does not function as resistance. As a result, the impact force of the inner barrel to hit the valve, and thus the speed of the bullet, is made stable and the performance of the air gun is improved.

With this invention, differing from the related art 2, a bullet is retained by the rotating biasing force and members can be downsized so that a retainer can also be placed above the inner barrel. Therefore, an air gun in which a magazine is situated below the inner barrel can be supported. An air gun which is natural from a viewpoint of design can be provided even if the retainer is situated above the magazine so that an air gun which is like a real gun can be manufactured.

DESCRIPTION OF THE PREFERRED EMBODIMENTS

Figure 20:
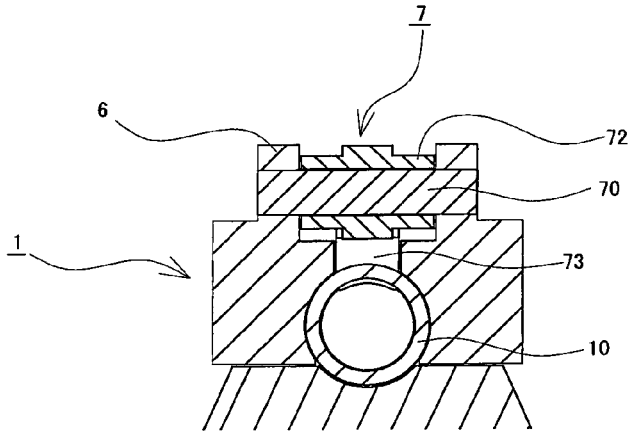
FIG. 20 is a cross-sectional view taken along line C of FIG. 16.

An air gun according to an embodiment of the present invention will now be explained using FIGS. 1 through 9 which are front views showing actions before shooting a bullet, FIGS. 10 through 13 respectively showing the front view, plan view, left side view and right side view, FIGS. 14 through 17 which are front magnified views of substantial parts showing the actions of the retainer of the air gun, and FIGS. 18 and 20 which are cross-sectional views taken along line A, B, C and D of FIGS. 14 through 17.

An air gun according to an embodiment of the present invention consists of gun main body 1, trigger 2 which is rotatable with respect to the gun main body centering on a trigger axis 3, magazine 16 and gas cylinder 18 contained in a grip 8, barrel weight 9, shear 4, inner barrel 10, chamber 6, retainer 7, hit pin 12, valve 13 and gas chamber 15. 18 is a gas cylinder contained in the grip 8, which is connected to a gas chamber 15 via gas supply opening 19.

Figure 1:
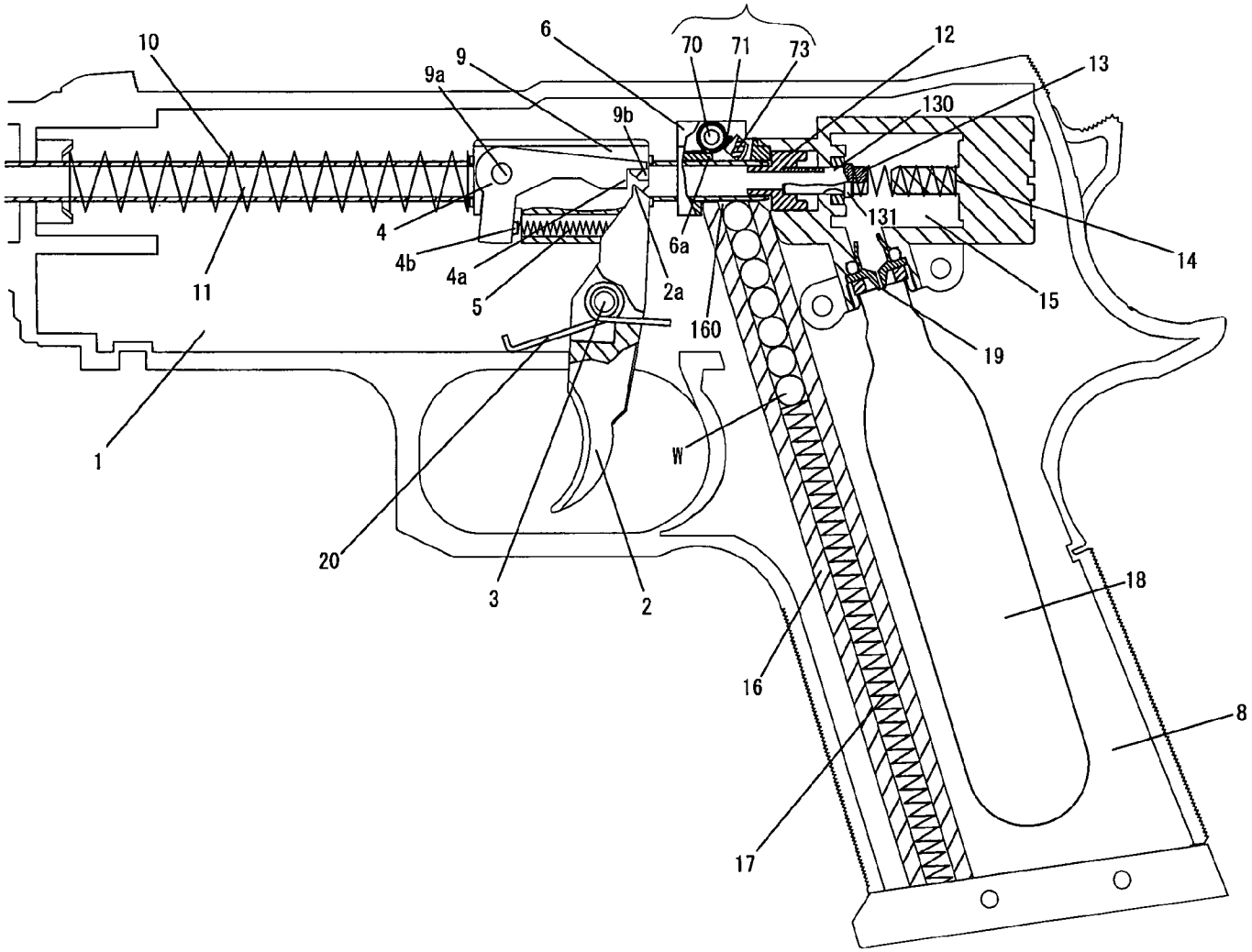
FIG. 1 is a front view showing the inner structure of the air gun in the initial state of an embodiment of the present invention.

The trigger 2 is equipped with a trigger spring 20. As shown in FIG. 1, the trigger 2 is biased rotatably in a clockwise direction by the trigger spring 20. The upper end 2*a* of the trigger 2 abuts on the shear 4. The upper end rotates towards the muzzle and presses the shear 4 by pulling the trigger 2 towards the rear side of the gun.

The barrel weight 9 is fixed to the outer surface of the inner barrel 10. The shear 4 is mounted rotatably centering on the shear rotational axis 9*a* mounted on the barrel weight 9. The tip of the shear 4*a* is biased downwards and latched with the shear engagement part 9*b* of the barrel weight 9 by biasing the spring receiver 4*b* towards the muzzle by the shear spring 5.

The inner barrel 10 is slidably inserted into the gun main body 1. The main spring 11 is placed on the peripheral surface of the muzzle side of the inner barrel 10. The main spring 11 biases the inner barrel 10 towards the rear end of the gun.

The chamber 6 is equipped so that the rear part of the inner barrel 10 can be inserted. The retainer 7 is equipped above the chamber 6, and the upper end opening 160 of the magazine 16 contained in the grip 8 is opened below the chamber. The bullets W are supplied to the chamber 6 one by one from the upper end opening 160 of the magazine 16. The upper end opening 160 of the magazine 16 is closed by the lower surface of the rear side of the inner barrel 10 when the air gun is in rest state (i.e., the state in which the trigger 2 is not pulled, refer to FIG. 1).

The retainer 7 is installed above the chamber 6 and the inner barrel 10, and is placed so that it can rotate in an anteroposterior direction of the gun centering on the retainer rotational axis 70 and is biased rotatably towards the retainer spring 71 (in a clockwise direction in the front view). The retainer rotational axis 70 is hooked and fixed to the left and right side of the chamber 6 of the gun.

The retainer 7 has a shape as shown in FIGS. 10 through 13, and has a retainer axis engagement part 72 and bullet abutment part 73, which in this embodiment are a single-piece. The retainer axis engagement part 72 is substantially tube shaped, with the retainer rotational axis 70 placed in the chamber 6 being rotatably engaged in the tube.

The bullet abutment part 73 is formed by projecting from a part of circumference of the tube of the retainer axis engagement part 72. The rotating tip has a concave abutment surface 730. In this embodiment, the shape of the concave abutment surface 730 of the bullet abutment part 73 seen from the axial direction of the retainer rotational axis 70 is like the rotational circular arc of the retainer. The shape seen from the axial direction and perpendicular direction of the retainer rotational axis 70 is that the center corresponding to the bullet W is concave.

When the air gun is in resting state, a part of bullet abutment part 73 of the retainer 7 is engaged with the upper surface of the inner barrel 10 and rotation towards the front of the gun is restricted when the air gun is in the resting state (i.e., the state in which the trigger 2 is not pulled, refer to FIG. 1). A part of the bullet abutment part of the retainer 7 abuts on the retainer engagement part 6*a* of the chamber 6, and rotation towards the front of the gun is restricted when the trigger 2 is pulled and the inner barrel 10 moves towards the front of the gun.

The hit pin 12 is made of a hollow member. It can move back and forth in the gun and is placed on the gun rear-end side of the chamber 6. The tip on the muzzle side of the hit pin 12 can be inserted into the inner barrel 10. The middle part has an abutment circumferential surface which abuts on the rear-end of the inner barrel 10. The valve 13 of the hit pin is inserted into the rear side of the gun.

The valve 13 consists of a circular body and has the gas vent hole 130 on the circumferential surface of the rear side. It can move back and forth in the gun with the hit pin 12. The tip side of the valve 13 is inserted into the rear side of the hit pin 12. The rear side of the valve 13 can be inserted into the gas chamber 15, and is biased towards the muzzle direction by the valve spring 14 placed in the gas chamber 15. In the resting state (the trigger 2 is not pulled), the valve 13 is biased in the direction of the muzzle by the valve spring 14 so that the opening on the side of the muzzle of the gas chamber 15 is closed by the circumferential convex part 131 at the rear-end of the gun so that the gas chamber 15 is made air-tight.

The magazine 16 is detachably placed in the grip 8 of the gun main body 1. The bullet W in the magazine 16 is biased upward by the magazine spring 17.

Figure 2:
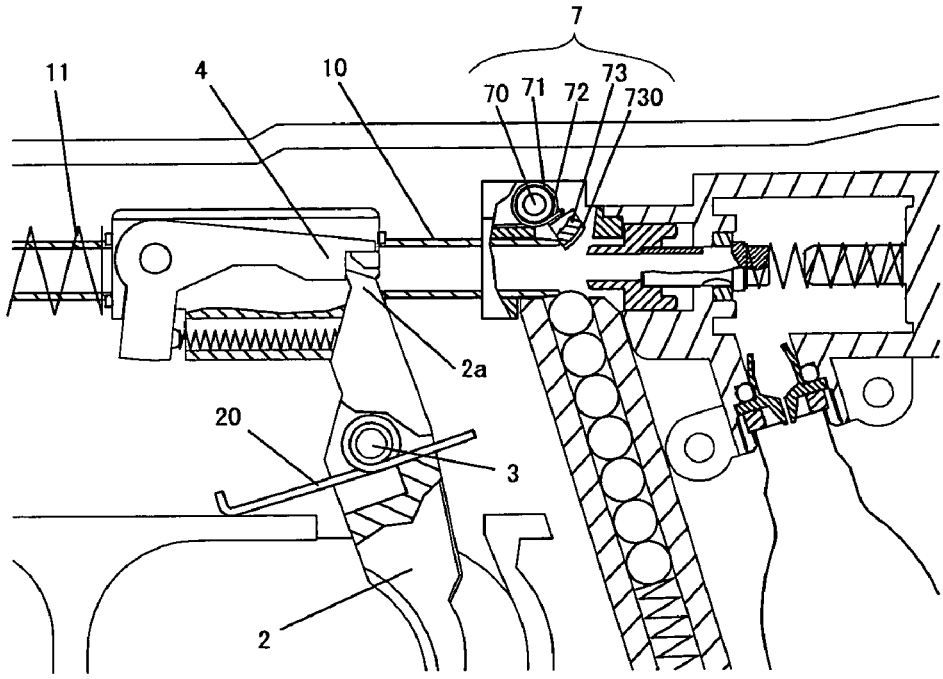
FIG. 2 is a front view showing the inner structure of the air gun when a trigger starts to be pulled from the state of FIG. 1.

The action of the air gun in the embodiment of the present invention will now be described. FIG. 2 shows a state where the trigger 2 is pulled towards the rear-end of the gun from the resting state shown in FIG. 1. When the trigger 2 starts to be pulled, the trigger 2 rotates around the trigger axis 3 resisting the rotational bias force of the trigger spring 20. The trigger upper end 2*a* rotates towards the front of the gun to press the shear 4 engaged by the trigger upper end 2*a*. The inner barrel 10 also moves towards the front of the gun by the movement of the shear 4 towards the front of the gun.

The inner barrel 10 moves towards the front of the gun resisting the biasing force of the main spring 11 to cause the main spring 11 to constrict. The retainer 7 rotates towards the front of the gun by the rotating biasing force of the retainer spring 71 towards the front of the gun by the movement of the inner barrel 10 towards the front of the gun. A part of the bullet abutment part 73 moves from the upper surface to the rear-end part of the inner barrel 10.

Figure 3:
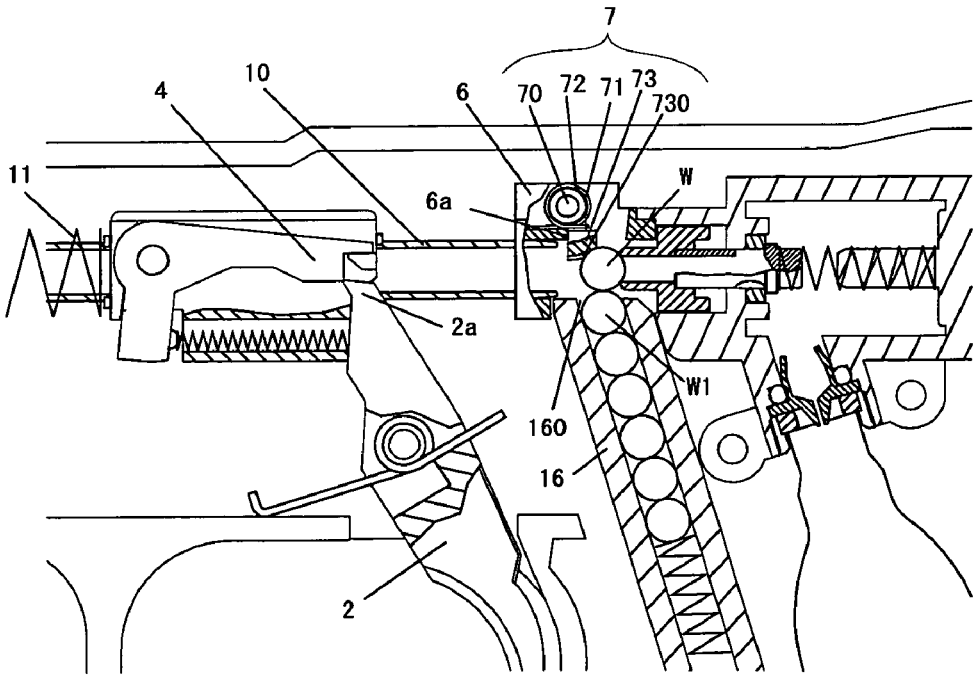
FIG. 3 is a front view showing the inner structure of the air gun when the trigger is further pulled from the state of FIG. 2 and a bullet enters the chamber.

FIG. 3 shows the state where the trigger 2 is further pulled from the state shown in FIG. 2. When the trigger 2 is further pulled, the trigger top end part 2*a* further rotates towards the front part of the gun and further moves the inner barrel 10 towards the front of the gun via the shear 4. In this state, a part of the bullet abutment part 73 of the retainer 7 abuts on the retainer engagement part 6*a* of the chamber 6, and is engaged, the rotation toward the front of the gun stops, and the gun goes into the resting state.

The upper opening 160 of the magazine 16 starts opening as a result of the movement of the inner barrel 10 towards the front of the gun. Finally, the bullets W are supplied into the chamber 6 from the upper opening of the magazine 16 one by one. At this time, the upper part of the bullet W stops by abutting on the concaved abutment surface 730 of the bullet abutment part 73 of the retainer 7 which is resting and abuts on the upper surface of the next bullet W1, and is engaged. At this moment, the center of the bullet W comes into line with the center of the void of the inner barrel 10.

Figure 4:
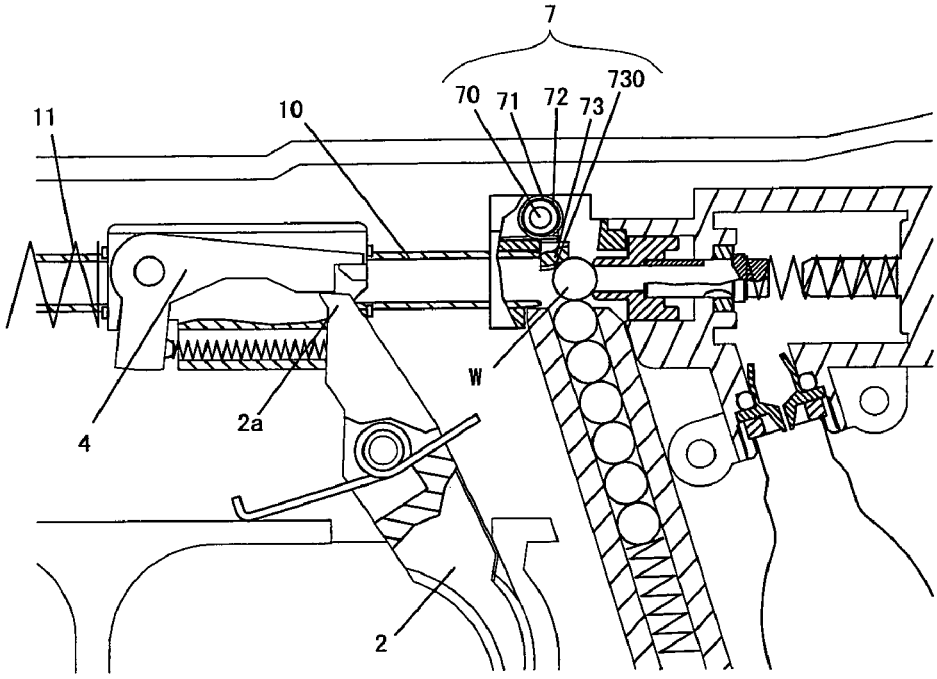
FIG. 4 is a front view showing the inner structure of the air gun when the trigger is further pulled from the state of FIG. 3 and engagement between the trigger and shear is released.

FIG. 4 shows a state where the trigger 2 is further pulled from the state shown in FIG. 3. When the trigger 2 is further pulled, the trigger upper end part 2*a* rotates and is removed from the shear 4, which makes a linear motion. The engagement between the shear 4 and the trigger upper end part 2*a* is released and the inner barrel 10 starts receding towards the rear-end side of the gun by the restoring biasing force of the main spring 11 which was pressed and constricted. When the inner barrel 10 recedes, the upper rear-end surface comes into collision with and presses the front side of the bullet abutment part 73 of the retainer 7. This pressing of the inner barrel 10 against the bullet abutment part 73 causes the retainer 7 to start rotating backward, about the retainer rotational axis 70 and resisting rotating biasing force of the retainer spring 71. At this time, the center of the bullet W is supported by the muzzle side opening part of the hit pin 12 and is aligned with the center of void of the inner barrel 10. Thus, the bullet W is inserted into the inner barrel 10 without coming in contact with the inner barrel 10.

Figure 5:
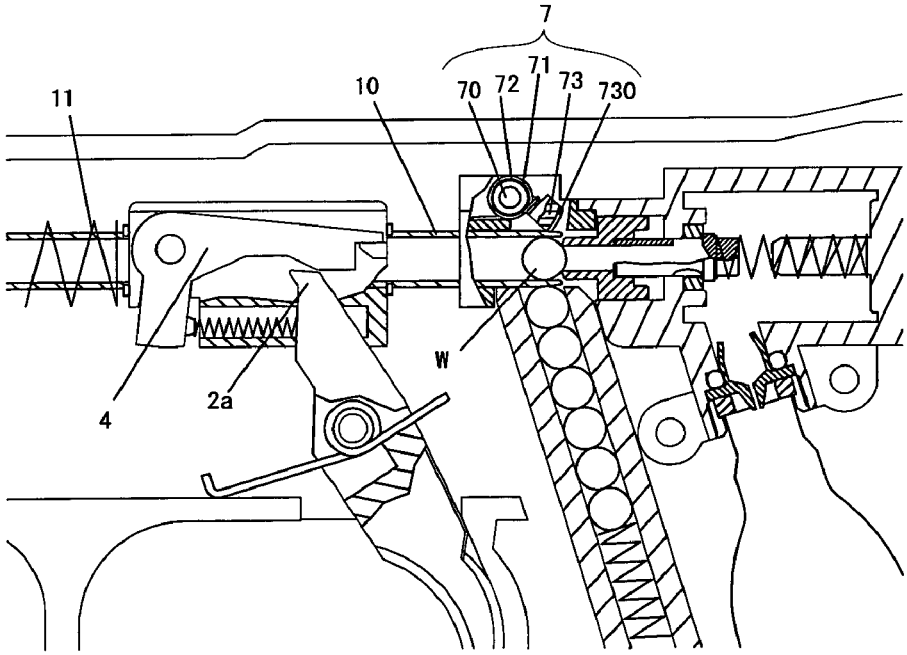
FIG. 5 is a front view showing the inner structure of the air gun when the inner barrel moves to the rear of the gun due to the biasing force of the main spring from the state of FIG. 4 and a bullet enters the inner barrel.

In FIG. 5, the engagement between the trigger upper end part 2*a* and the shear 4 is released. The inner barrel 10 presses the bullet abutment part 73 and rotates the retainer 7 backward while it backs away towards the rear-end of the gun due to the restoring biasing force of the main spring 11. The abutment between the concave abutment surface 730 of the retainer 7 and the bullet W is released, the tip of the bullet abutment part 73 abuts on the upper circumferential surface of the inner barrel 10 and the rotation stops. At the same time, the bullet W enters the inner barrel 10 from the rear-end opening of the inner barrel 10.

Figure 6:
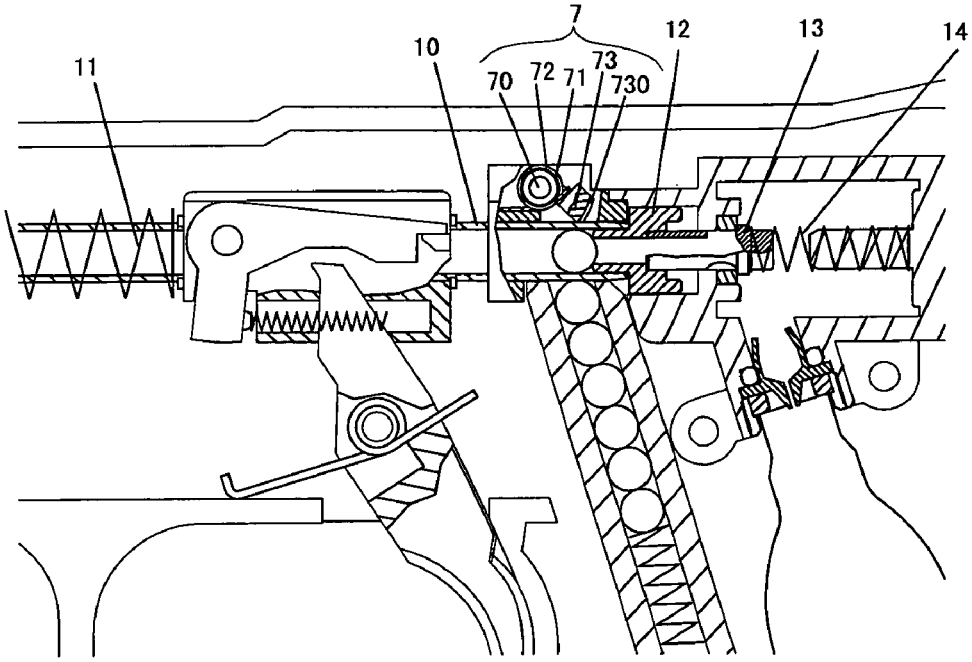
FIG. 6 is a front view showing the inner structure of the air gun at the instant when the inner barrel further moves towards the rear side of the gun from the state of FIG. 5 due to the biasing force of the main spring, and the inner barrel contacts the hit pin.

FIG. 6 shows the state where the inner barrel 10 further continues to recede towards the rear-end of the gun due to the restoring biasing force of the mainspring 11 from the state shown in FIG. 5 and the rear-end surface comes into contact with and presses the muzzle side end surface of the hit pin 12. As a result, the hit pin 12 starts receding towards the rear-end side of the gun, and the connected valve 13 also recedes resisting the biasing force of the valve spring 14.

Figure 7:
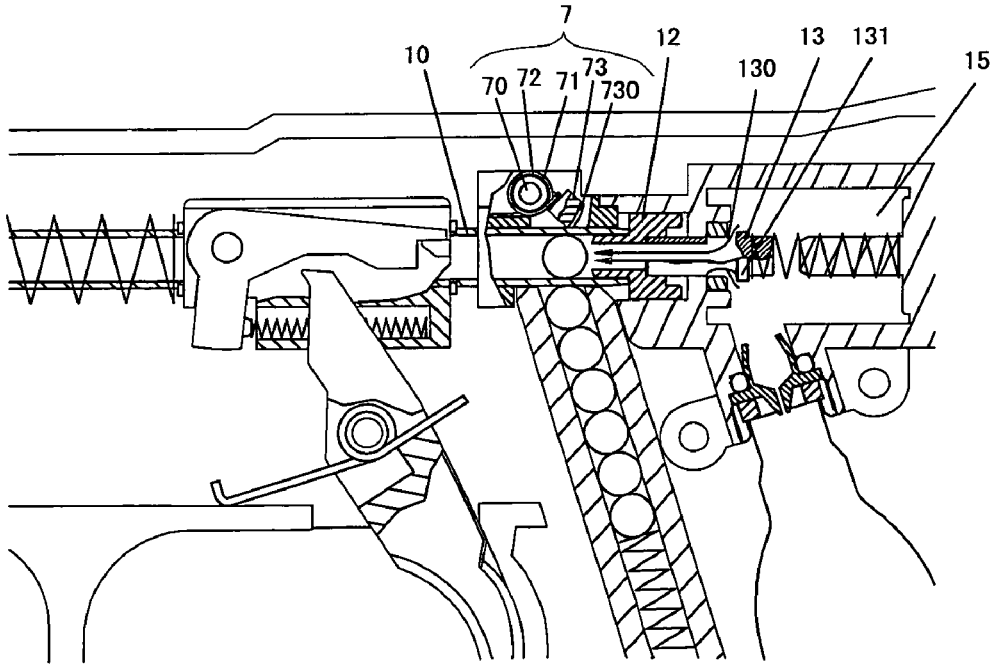
FIG. 7 is a front view showing the inner structure of the air gun when the inner barrel further moves towards the rear side of the air gun due to the biasing force of the main spring from the state shown in FIG. 6, pushes the valve via the hit pin, and the high-pressure gas starts entering the inner barrel from the gas chamber.

FIG. 7 shows the state where the inner barrel 10 further continues to recede from the state shown in FIG. 6 and makes the valve 13 move towards the rear-end of the gun via the hit pin 12. Then, a peripheral convex part 131 of the rear-end of the gun of the valve 13 is removed from the inner wall of the gas chamber 15 and the vent hole 130 enters the gas chamber 15. Then, the air-tight state in the gas chamber 15 is broken and the high-pressure gas passes through the vent hole 130, valve 13 and through the inside of the hit pin 12 to flow into the inner barrel 10.

Figure 8:
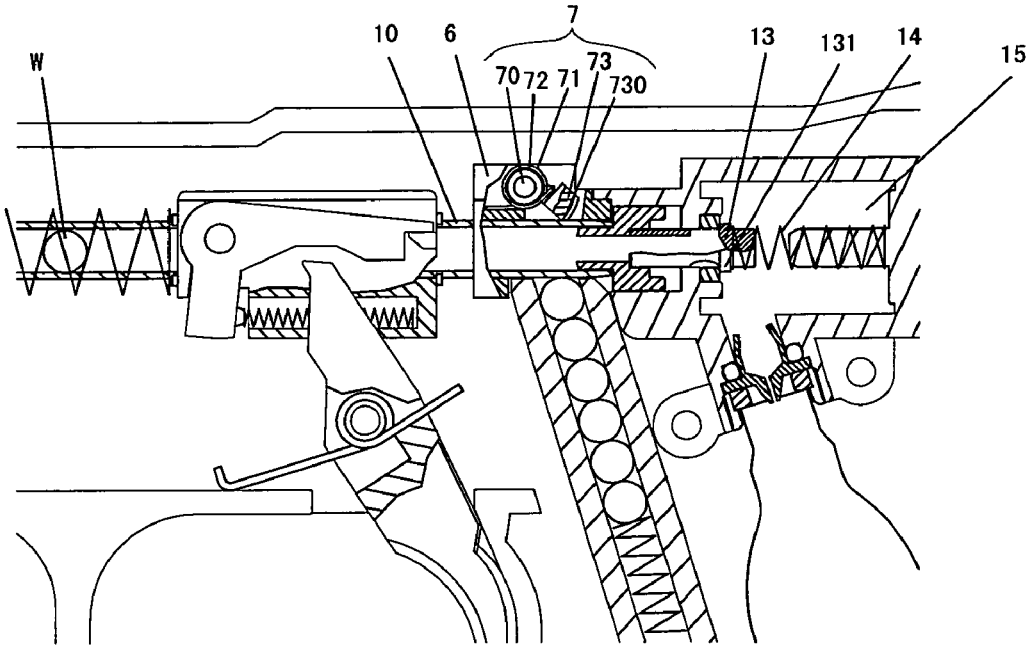
FIG. 8 is a front view showing the inner structure of the air gun when a bullet is moving towards the muzzle in the inner barrel due to the gas pressure from the state shown in FIG. 7.

FIG. 8 shows the state where the bullet W in the inner barrel 10 in the chamber 6 is discharged by the high-pressure gas that has flowed into the inner barrel 10 from the gas chamber 15. The valve 13 receded in the gas chamber 15 advances by the restoration biasing force of the valve spring 14. The opening on the muzzle side of the gas chamber 15 is closed by the peripheral convex part 131 of the rear-end of the gun and the gas chamber 15 is made air-tight again. Thus, the flow of the high-pressure gas into the inner barrel 10 stops.

Figure 9:
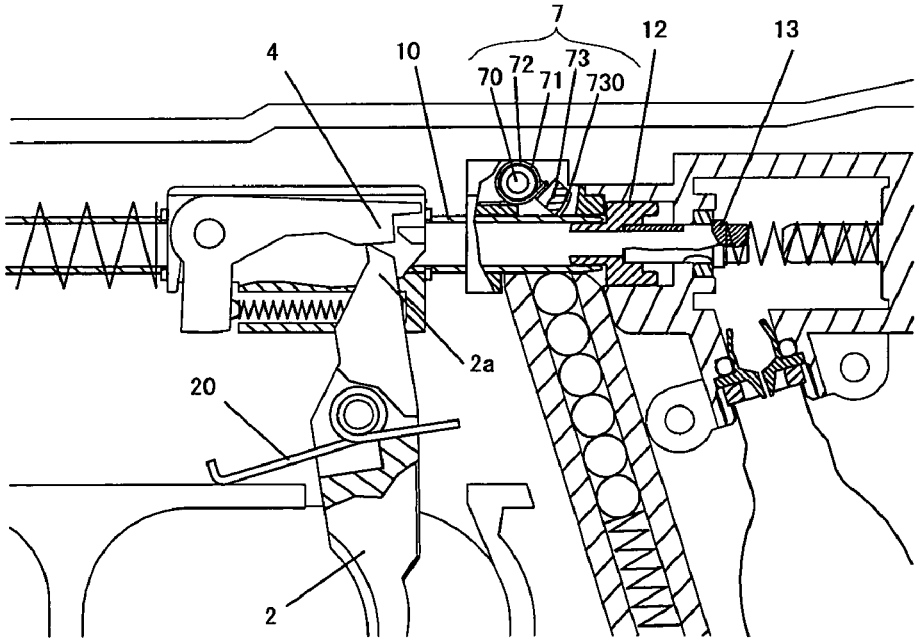
FIG. 9 is a front view showing the inner structure of the air gun immediately before the inner barrel moves towards the muzzle due to the biasing force of the valve spring from the state shown in FIG. 8, and the trigger returns to the initial state shown in FIG. 1.
Figure 10:
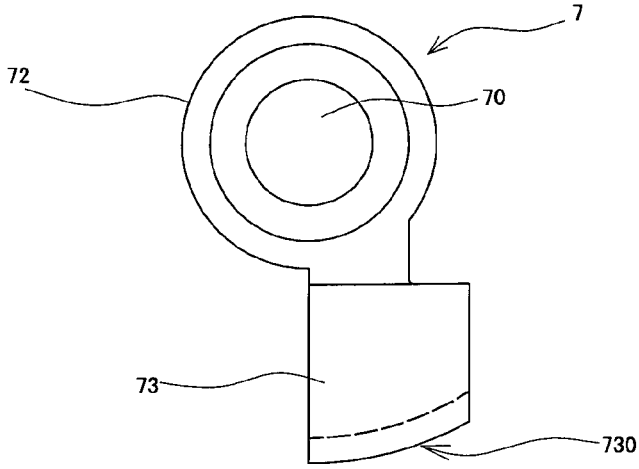
FIG. 10 is a front view of the retainer of an air gun according to an embodiment of the present invention.
Figure 11:
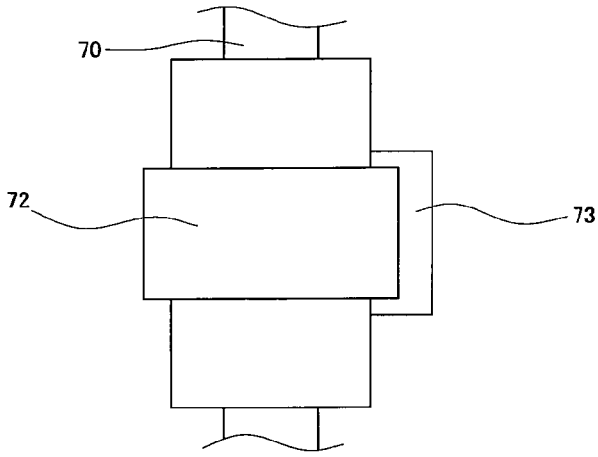
FIG. 11 is a plain view of a retainer of an air gun in accordance with an embodiment of the present invention.
Figure 12:
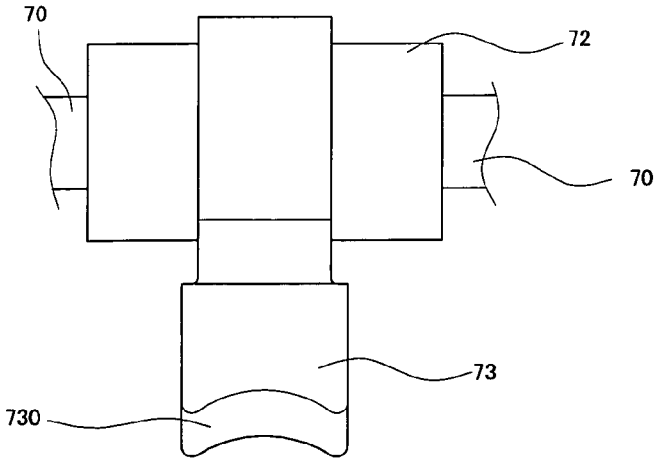
FIG. 12 is a right side view of a retainer of an air gun according to an embodiment of the present invention.
Figure 13:
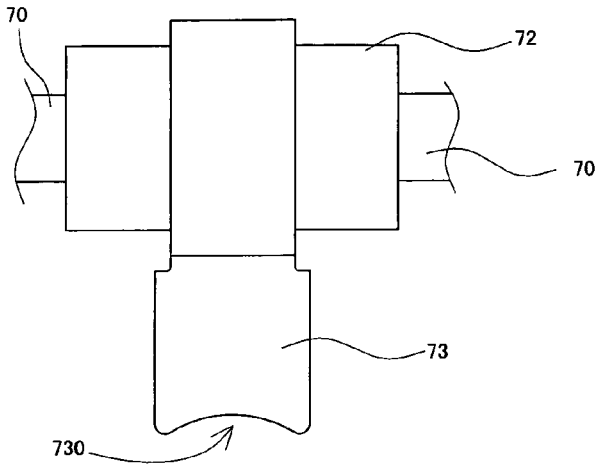
FIG. 13 is a left side view of a retainer of an air gun according to an embodiment of the present invention.

FIG. 9 shows the state where the inner barrel 10 also advances slightly towards the muzzle due to the advancement of the valve 13. The trigger upper end part 2*a* rotates towards the rear-end of the gun and has contact with the shear 4 because the trigger 2 rotates, reversely by the rotating biasing force of the trigger spring 20 when a shooter releases their finger. From the state shown in FIG. 9, the trigger upper end part 2*a* further rotates towards the rear-end of the gun and is positioned at the rear side of the shear 4. The gun moves into the resting state as shown in FIG. 1.

Figure 14:
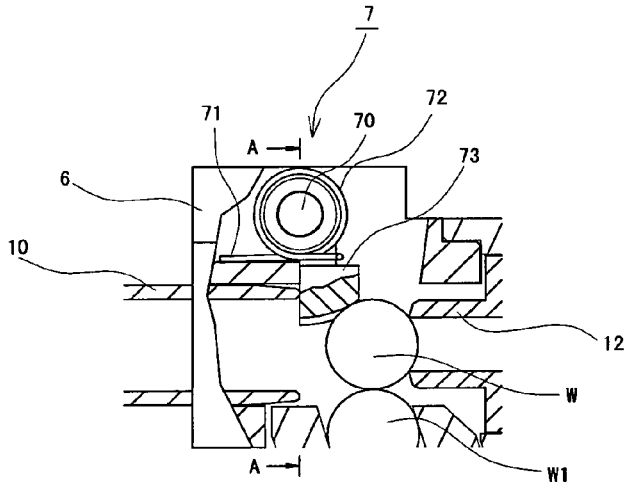
FIGS. 14 through 17 are magnified views of substantial parts showing the actions of the retainer of the air gun according to an embodiment of the present invention.
Figure 15:
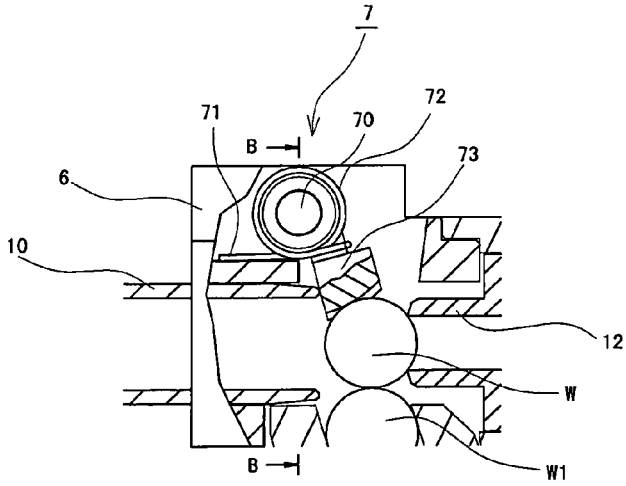
Figure 16:
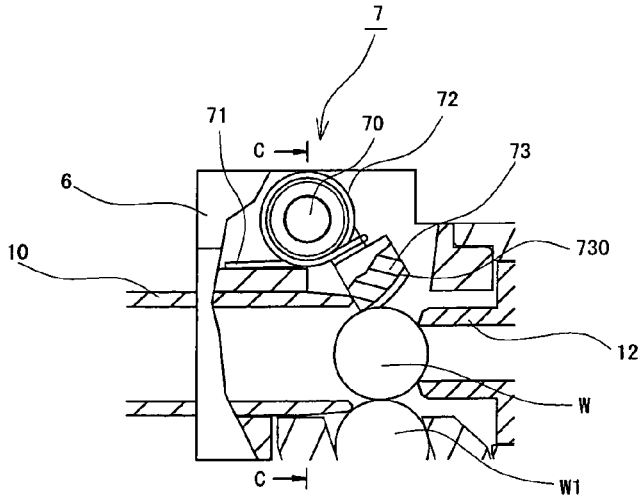

The present invention will now be explained referring to FIGS. 14 through 17 which are magnified views of substantial parts showing the actions of the retainer of the present invention. The rear-end surface of the inner barrel 10 hits against the muzzle surface of the bullet abutment part 73 of the retainer 7 when the inner barrel 10 recedes due to the restoring biasing force of the main spring 11 (FIGS. 14 and 18).

The bullet abutment part 73 starts rotating backward resisting the rotating biasing force of the retainer spring 71, about the retainer rotational axis 70, accompanying the backward movement of the inner barrel 10. At this time, the central concave of the concave abutment surface 730 exists in an anteroposterior direction of the retainer 7. The concave abutment surface 730 consists of a convex curve similar to the rotating arc when seen from the axial direction of the retainer rotational axis 70. Thus, as shown in FIG. 15, FIGS. 19 through 16, and FIG. 20, the retainer 7 can rotate smoothly along the spherical surface of the bullet W.

Figure 17:
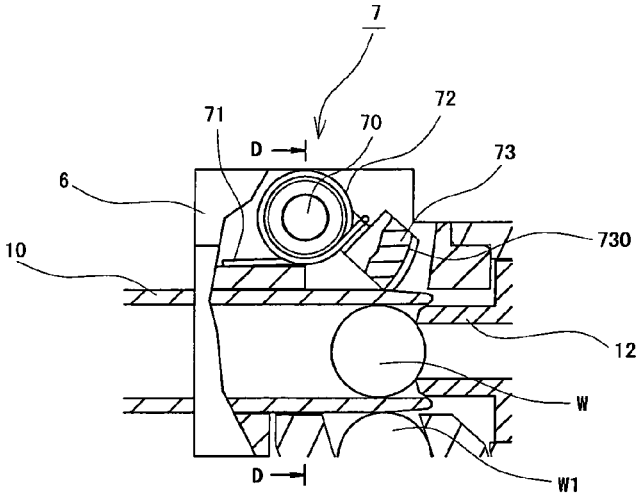
Figure 18:
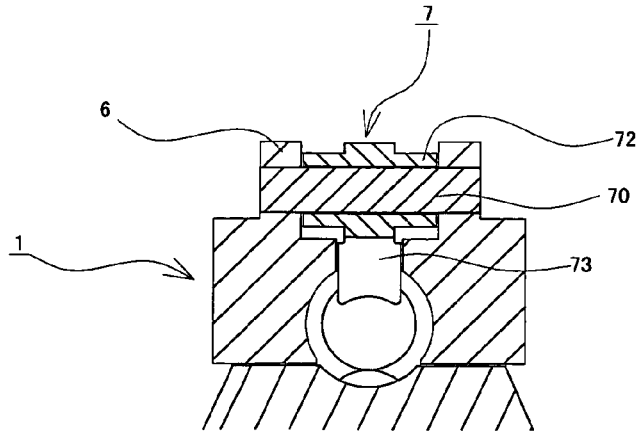
FIG. 18 is a cross-sectional view taken along line A of FIG. 14.
Figure 19:
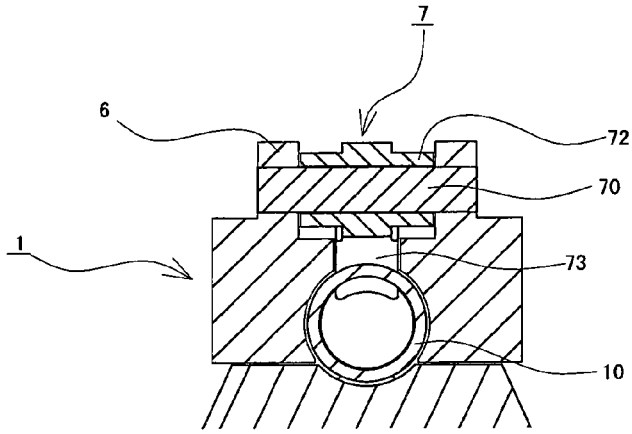
FIG. 19 is a cross-sectional view taken along line B of FIG. 15.
Figure 21:
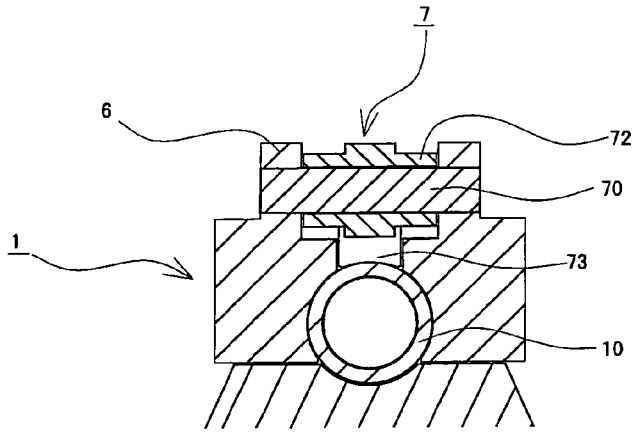
FIG. 21 is a cross-sectional view taken along line D of FIG. 17.
Figure 22:
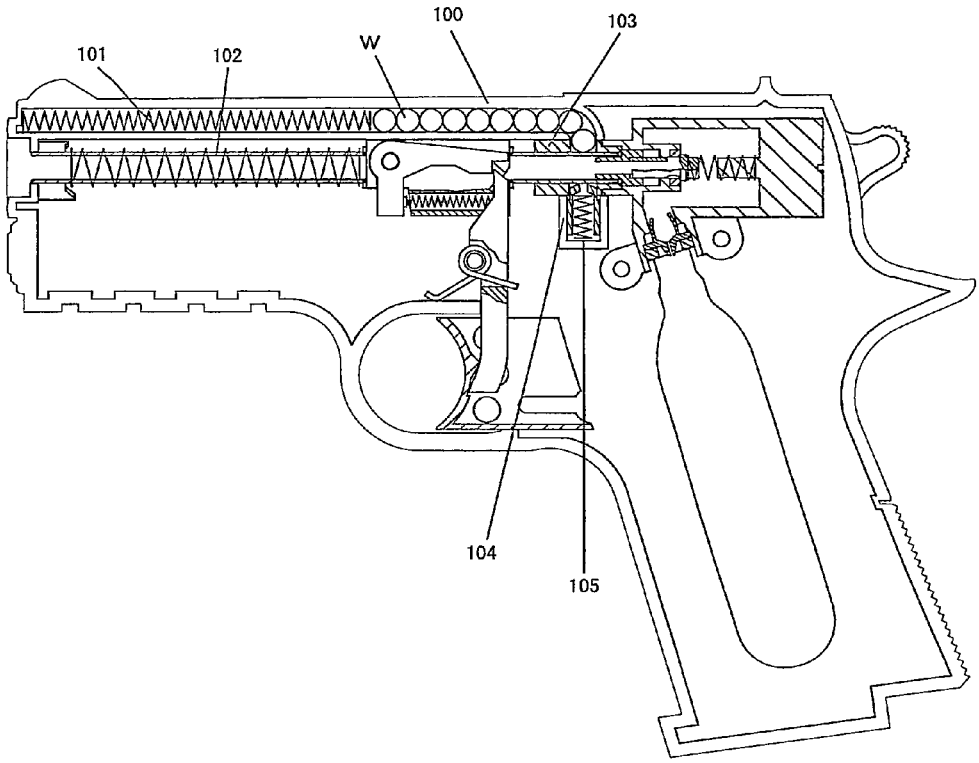
Fig. 22 PRIOR ART
FIG. 22 is a front view showing the inner structure of the air gun according to the conventional technology.
Figure 23:
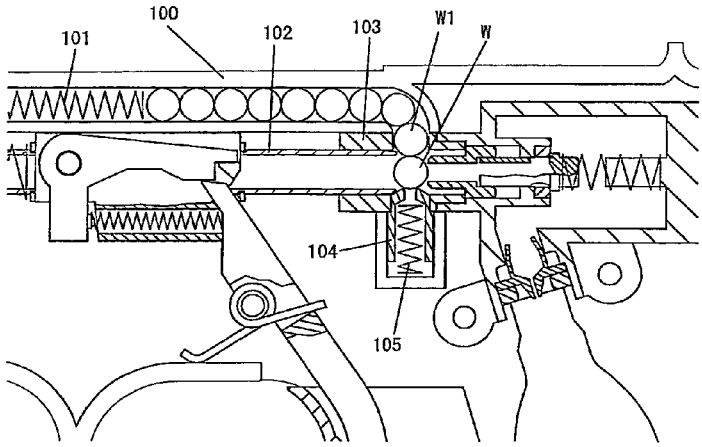
Fig. 23 PRIOR ART
FIG. 23 is an explanatory drawing of substantial parts showing the actions of an air gun according to the conventional technology.
Figure 24:
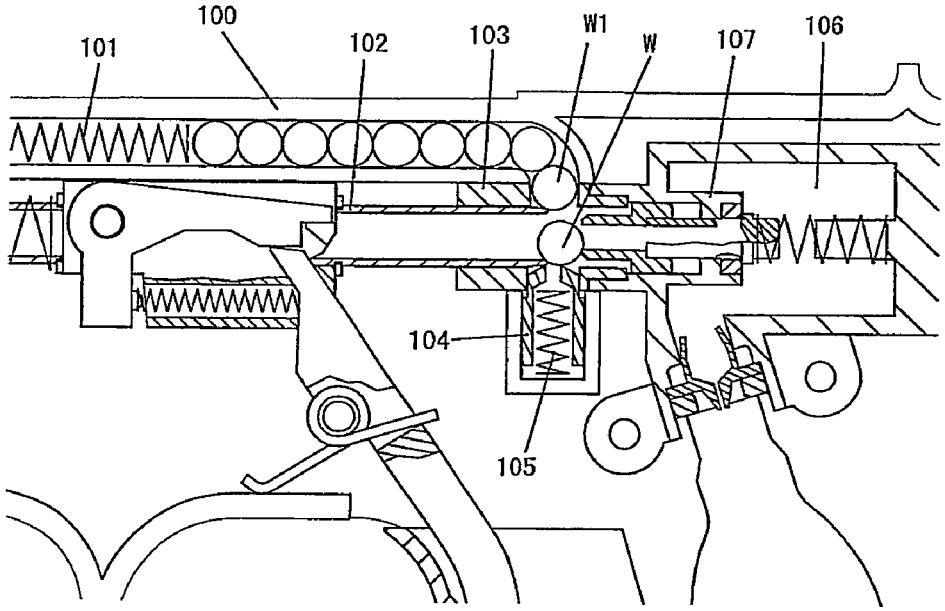
Fig. 24 PRIOR ART
FIG. 24 is an explanatory drawing of substantial parts showing the actions of an air gun according to the conventional technology.
Figure 25:
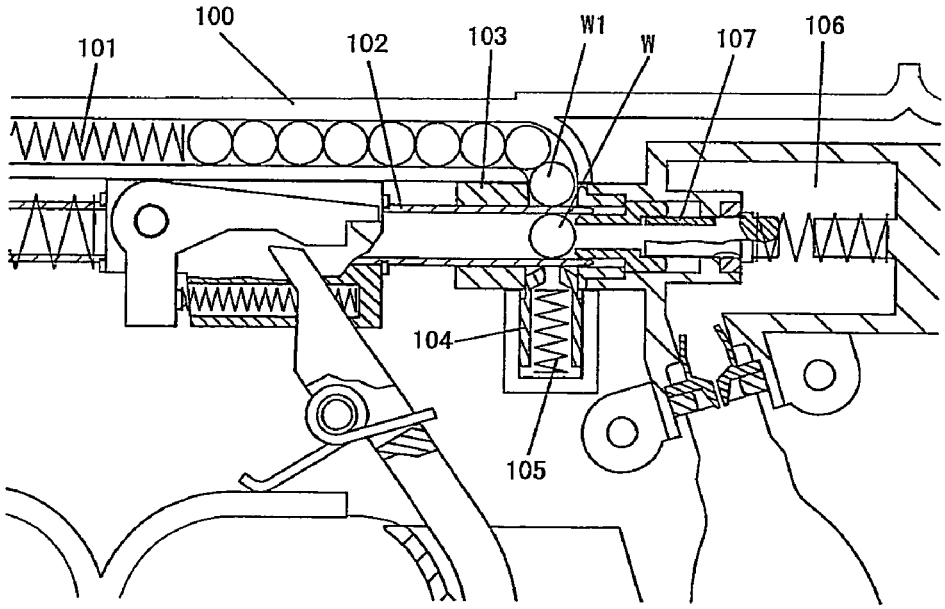
Fig. 25 PRIOR ART
FIG. 25 is an explanation drawing of substantial parts showing the actions of an air gun according to the conventional technology.

As shown in FIGS. 17 and 21, the bullet abutment part 73 of the retainer 7 slides on the upper surface of the inner barrel 10 due to the rotating biasing towards the front direction by the retainer spring 21 when the bullet abutment part 73 of the retainer 7 is positioned at the upper surface of the peripheral surface of the inner barrel 10. At the same time, the bullet W is supported by the tip surface of the bullet abutment 73 and hit pin 12, and the upper surface of the next bullet W 1 is inserted into the inner barrel 10 without colliding with the inner barrel 10.

According to the embodiment of the present invention, the retainer 7 is rotated by the retainer spring 71 towards the front of the gun, but the biasing force is not made stronger and is in fact much weaker than the related art 2, and thus the friction resistance against the upper surface of the inner barrel 10 is very small.

In the related art 2, the biasing force of the main spring 11 should be strong in order to cause the inner barrel 10 to retreat against the strong biasing force, because the biasing force of the retainer spring 105 is strong. The frictional force against the inner barrel 10 is very small because the retainer spring 71 of the present invention has a rotational biasing force. Therefore, the biasing force of the main spring 11 for retreating the inner barrel 10 may be weak. The force for pulling the trigger 2 to advance the inner barrel 10 is also small. Thus, this invention has an advantage of improving the operability of the air gun.

The present invention can be used in air guns for competitions and amusement.

What is claimed is:

1. An air gun having a trigger and adapted to discharge a bullet therefrom using compressed gas, the air gun comprising:

a bullet-receiving chamber formed inside of the air gun and sized to receive the bullet therein;

a hollow inner barrel rectilinearly movable in a forward direction and an opposite rearward direction inside the air gun, the inner barrel being resiliently biased towards the rearward direction and having a rear end portion;

a spring-load magazine containing the bullet and urging the bullet into the bullet-receiving chamber; and a retainer pivotably connected to the air gun, disposed opposite the magazine and having a bullet abutment part that enters into and moves out of the bullet-receiving chamber, the retainer being resiliently biased to pivot in the forward direction so that the bullet abutment part is urged to enter into the bullet-receiving chamber, wherein, in a trigger rest position, the rear end portion of the inner barrel prevents the bullet and the bullet abutment part from entering into the bullet-receiving chamber, and, upon pulling the trigger to a first trigger position from the trigger rest position, the inner barrel moves in the forward direction to permit the bullet and the bullet abutment part to enter the bullet-receiving chamber where the bullet abutment part contacts and retains the bullet therein, and, upon pulling the trigger to a second trigger position beyond the first trigger position, the inner barrel moves in the rearward direction to capture the bullet therein while causing the retainer to pivot in the rearward direction to thereby move the bullet abutment part out of the bullet-receiving chamber and thereafter causing the compressed gas to enter the inner barrel now loaded with the bullet in order to discharge the bullet from the air gun.

* * * * *